US008707885B2

(12) United States Patent
Nguyen

(10) Patent No.: US 8,707,885 B2
(45) Date of Patent: Apr. 29, 2014

(54) MULTI-FUNCTIONAL BENCH SYSTEM FOR INFLATABLE BOATS

(76) Inventor: Tin Mac Nguyen, Fort Washington, MD (US)

( * ) Notice: Subject to any disclaimer, the term of this patent is extended or adjusted under 35 U.S.C. 154(b) by 139 days.

(21) Appl. No.: 13/301,839

(22) Filed: Nov. 22, 2011

(65) Prior Publication Data

US 2012/0132128 A1 May 31, 2012

Related U.S. Application Data

(60) Provisional application No. 61/458,548, filed on Nov. 29, 2010.

(51) Int. Cl.
*B63B 17/00* (2006.01)
*B63B 35/58* (2006.01)

(52) U.S. Cl.
USPC ..... 114/363; 440/40

(58) Field of Classification Search
USPC ..... 114/363, 345, 347, 348, 349; 441/40; 297/29, 42–60
See application file for complete search history.

(56) References Cited

U.S. PATENT DOCUMENTS 3,694,835 A * 10/1972 Casey et al. ..... 114/345
4,290,156 A * 9/1981 Rawson ..... 114/343
4,795,387 A * 1/1989 Morgan ..... 441/130
4,909,177 A 3/1990 Jones
5,154,134 A 10/1992 Goldsmith
5,325,806 A 7/1994 Lee
6,651,776 B2 * 11/2003 Montecer, Jr. ..... 182/196
6,925,955 B1 8/2005 Brooks
6,945,190 B1 * 9/2005 Frandsen ..... 114/363
8,393,288 B1 * 3/2013 Ramsey ..... 114/345

* cited by examiner

*Primary Examiner* — Lars A Olson
*Assistant Examiner* — Andrew Polay
(74) *Attorney, Agent, or Firm* — Tarolli, Sundheim, Covell & Tummino LLP

(57) ABSTRACT

One aspect of the present invention includes a multi-functional bench system for an inflatable boat having a bottom wall, spaced apart first and second tubular side walls, and an outboard motor. The bench system includes a first seating unit, a second seating unit, and an adjustable bracing assembly. The first seating unit is snugly mounted to a portion of the first tubular side wall. The first seating unit includes a first leg assembly hingedly connected to a first handle assembly. The second seating unit is snugly mounted to a portion of the second tubular side wall. The second seating unit includes a second leg assembly hingedly connected to a second handle assembly. The adjustable bracing assembly is positioned about the bottom wall of the inflatable boat and securely interconnects the first and second leg assemblies.

16 Claims, 17 Drawing Sheets

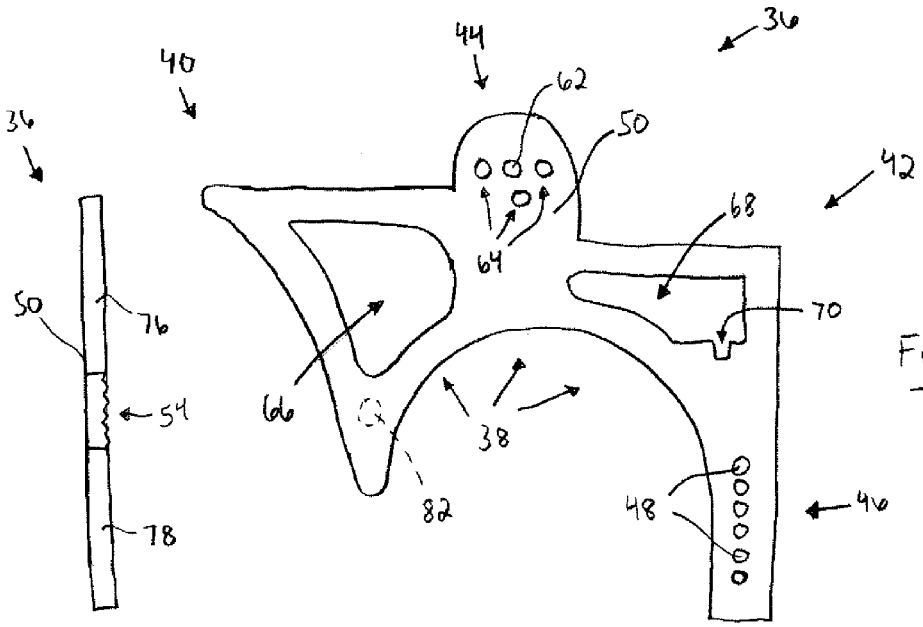
Fig. 4A
Fig 4D
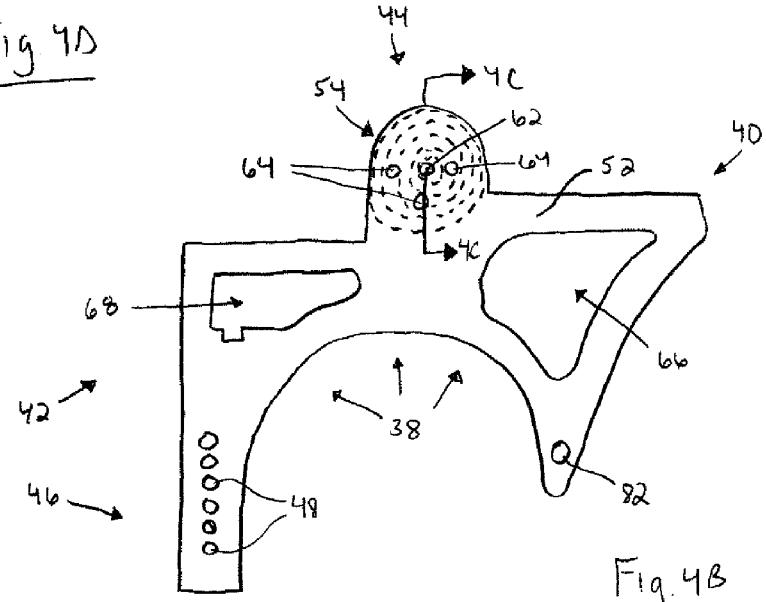
Fig. 4B
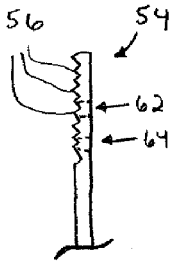
Fig. 4C
36

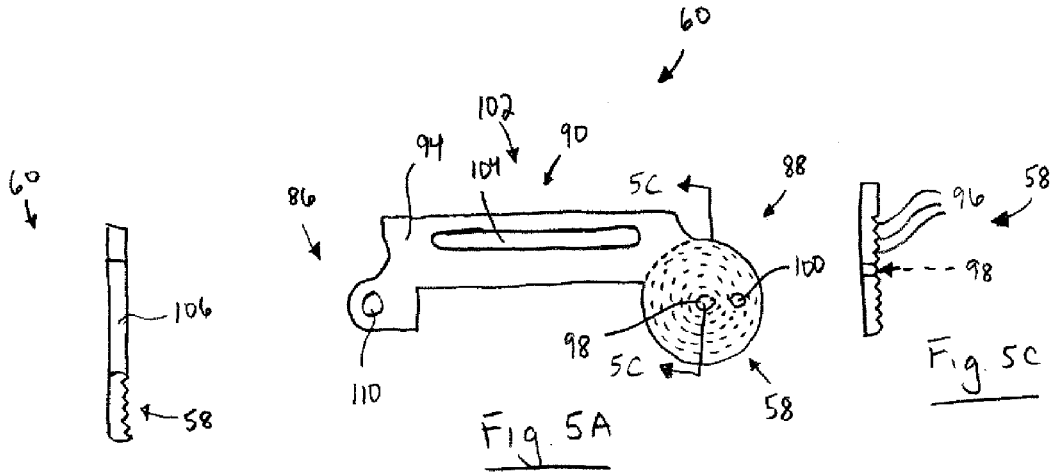
Fig. 5A
Fig. 5C
Fig. 5D
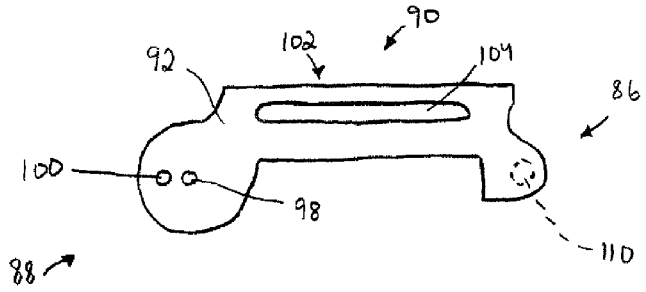
Fig. 5B
60

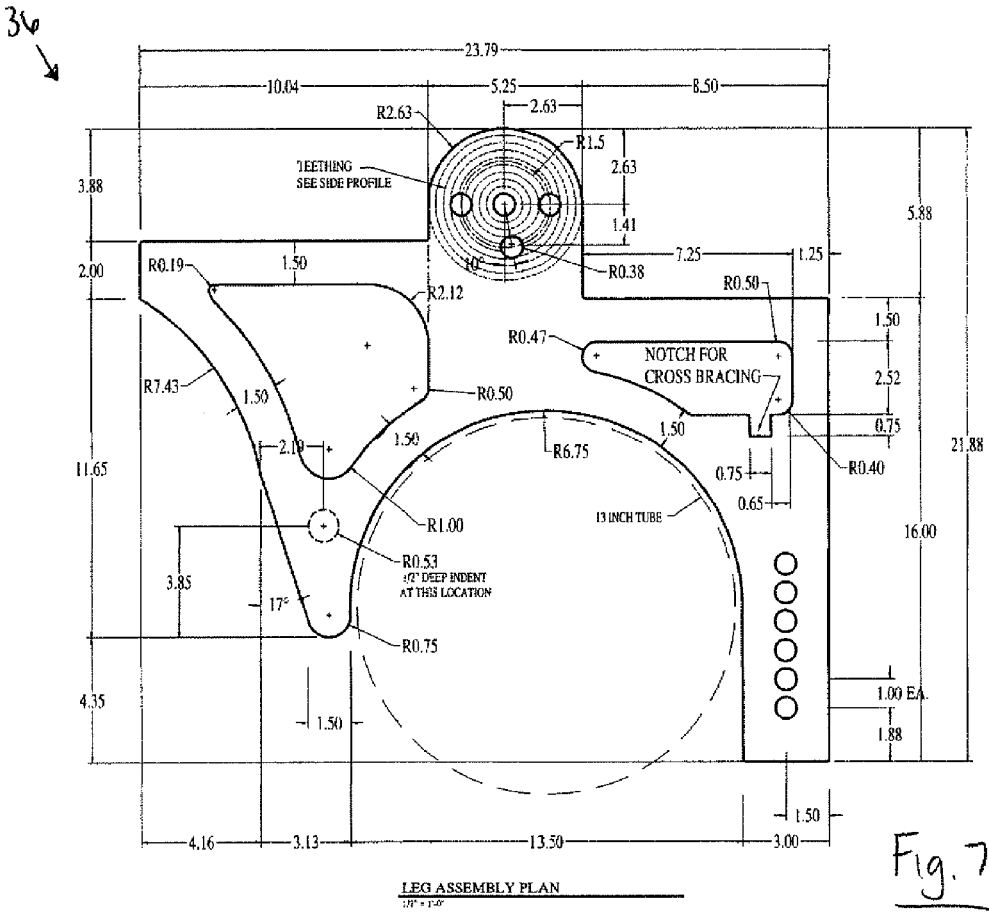
Fig. 7A
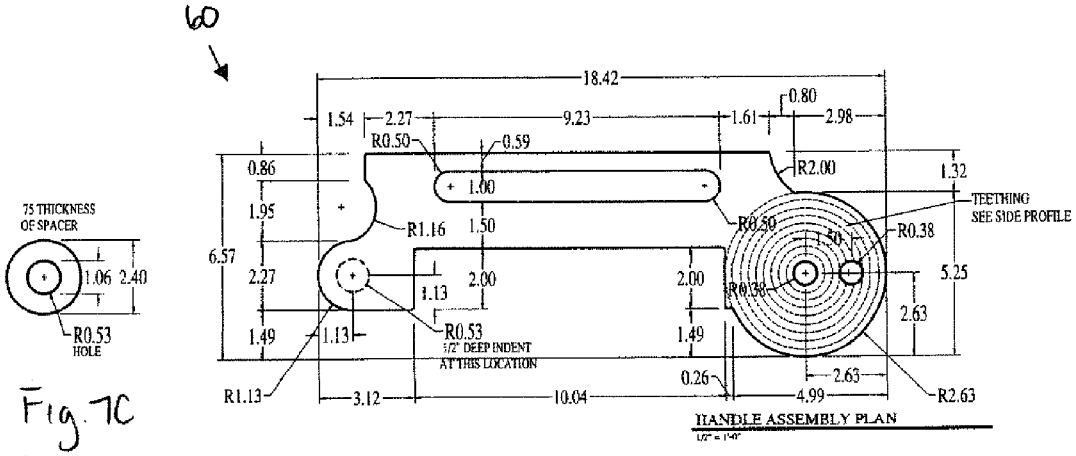
Fig. 7C
Fig. 7B

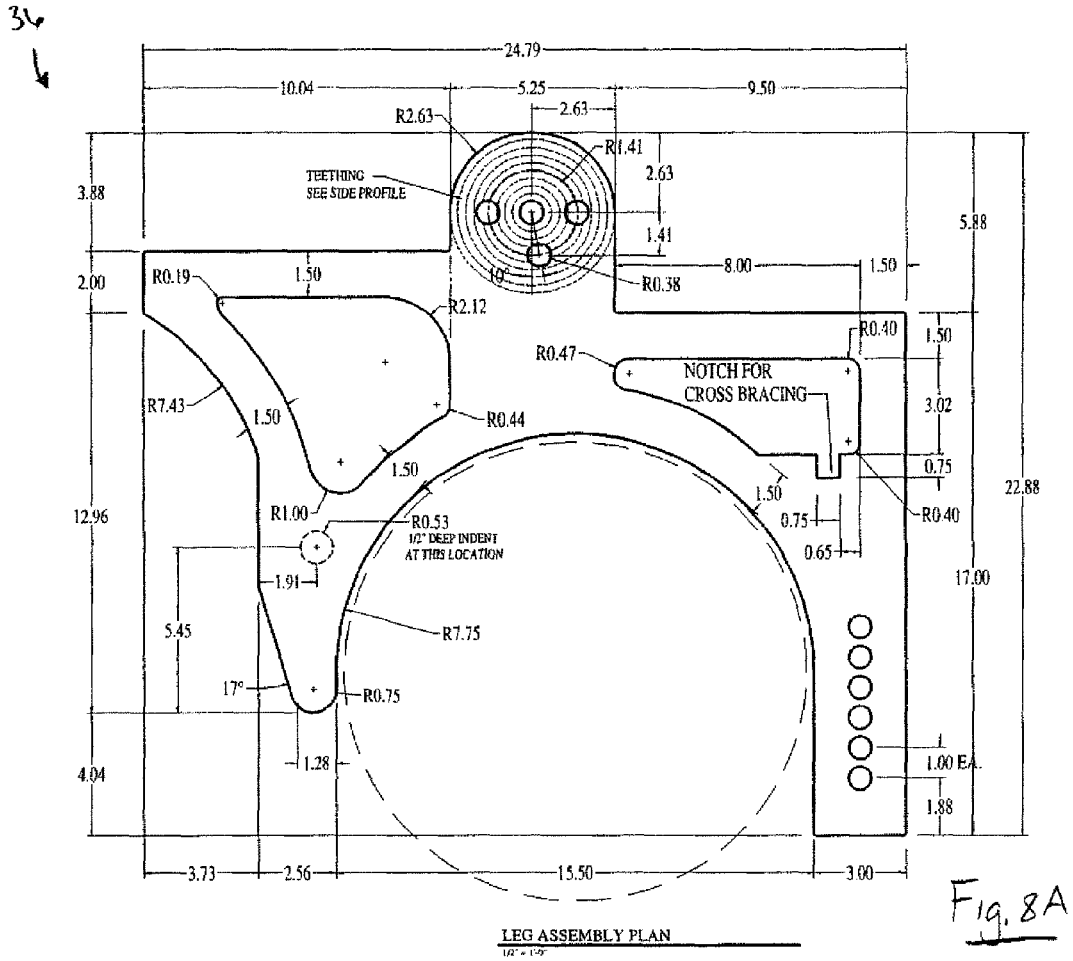
Fig. 8A
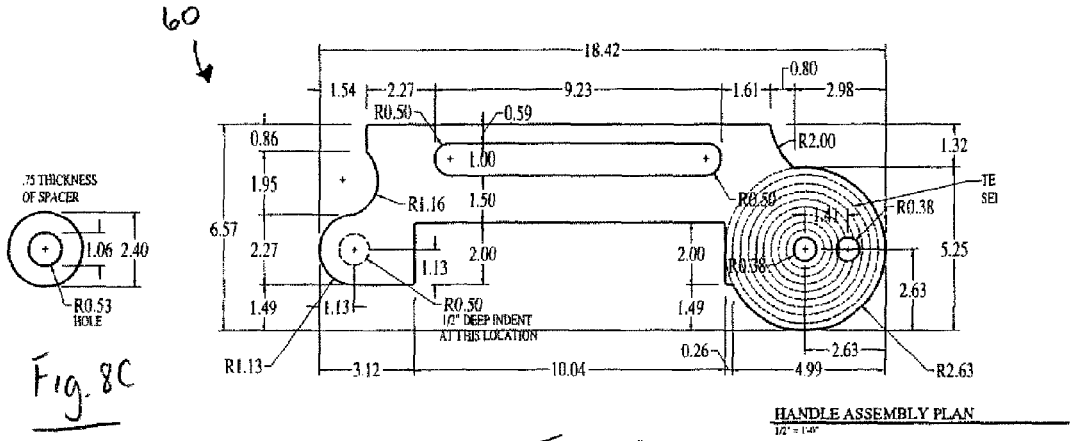
Fig. 8C
Fig. 8B

BRACING ASSEMBLY PLAN

BRACING ASSEMBLY PLAN

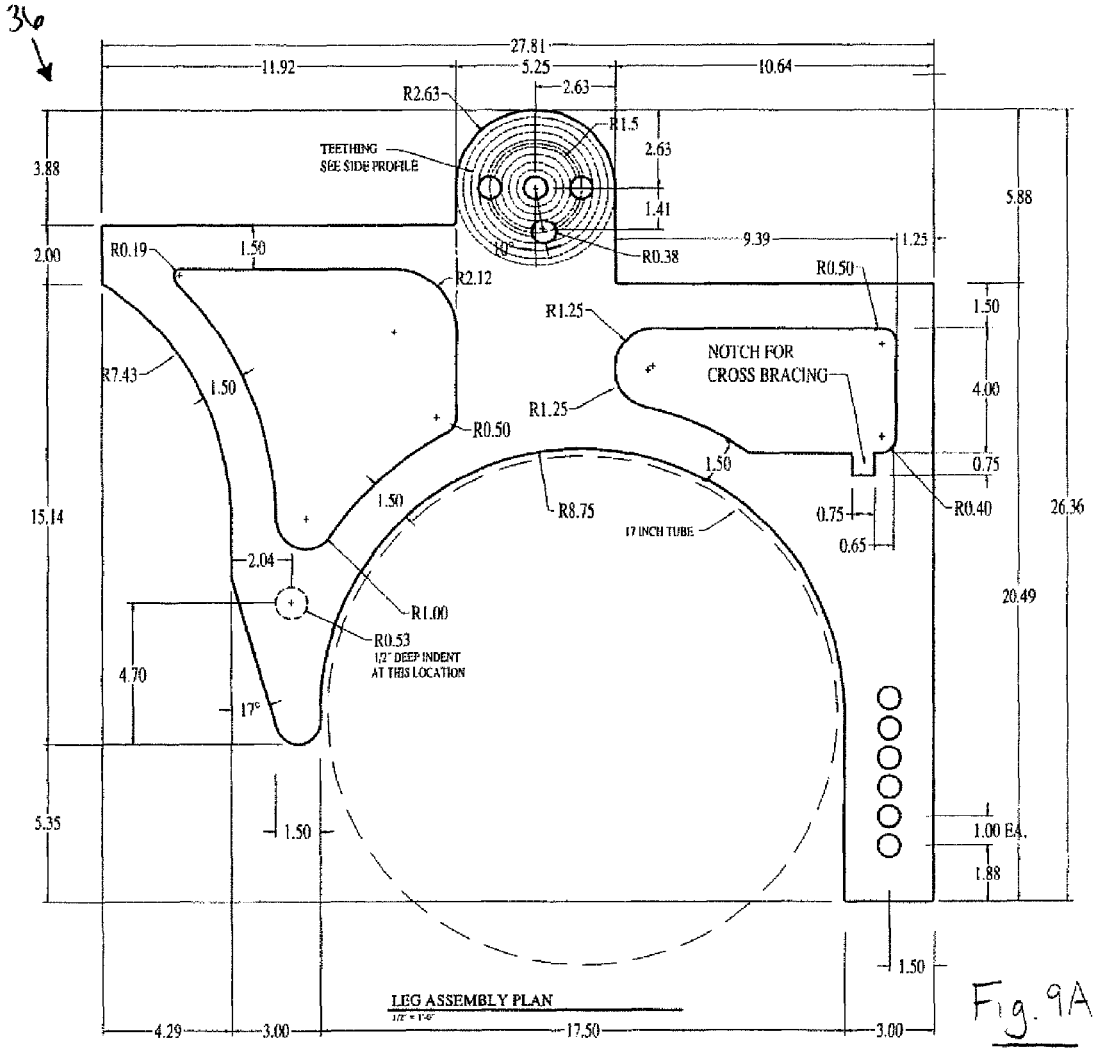
Fig. 9A
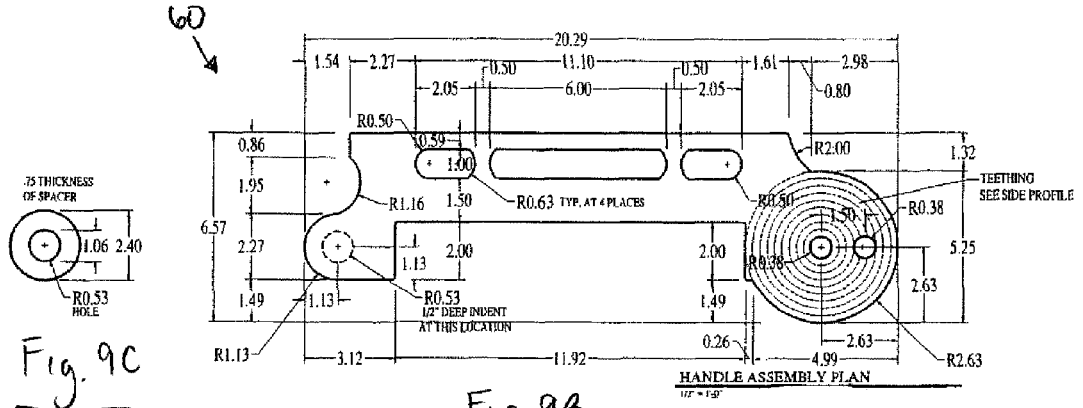
Fig. 9C
Fig. 9B

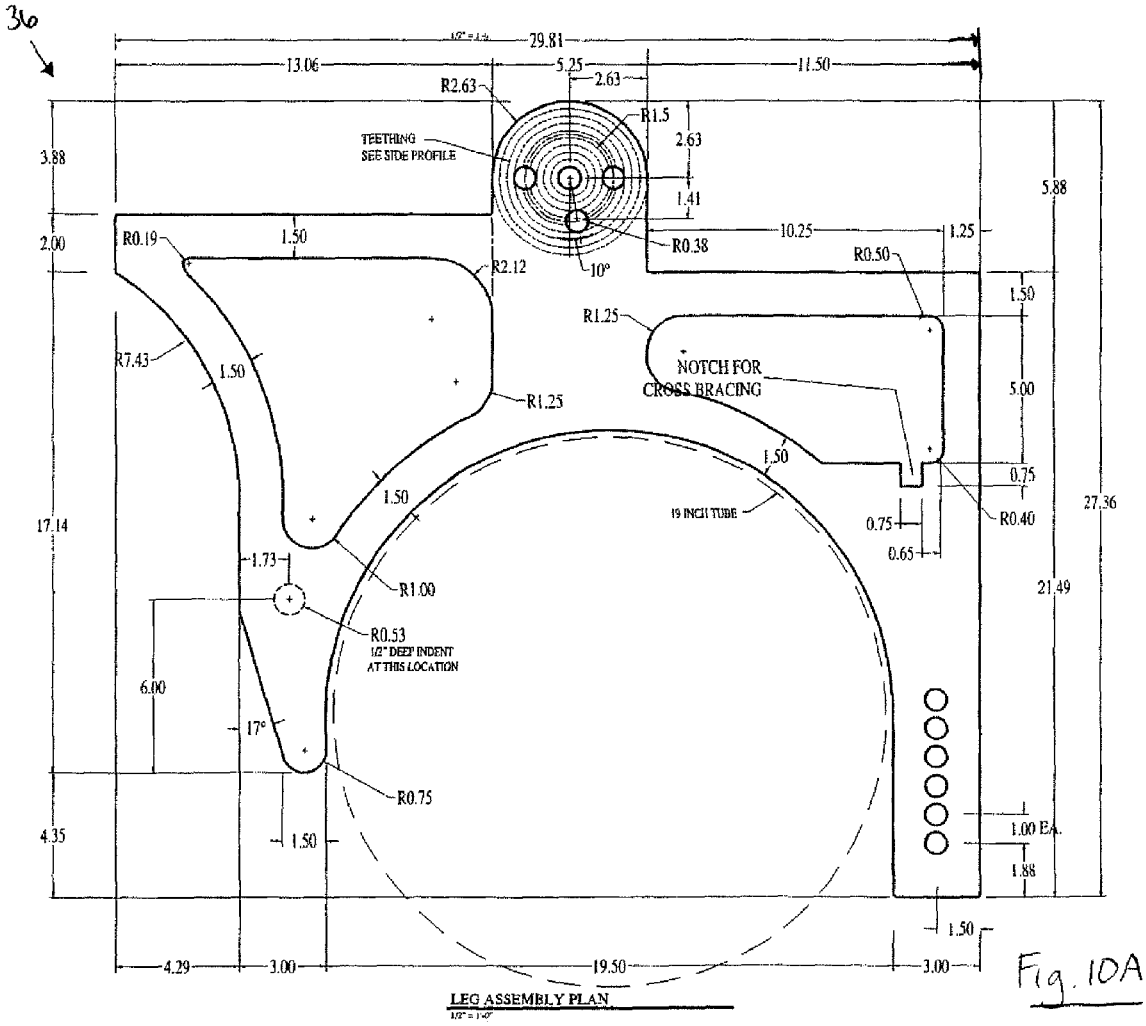
Fig. 10A
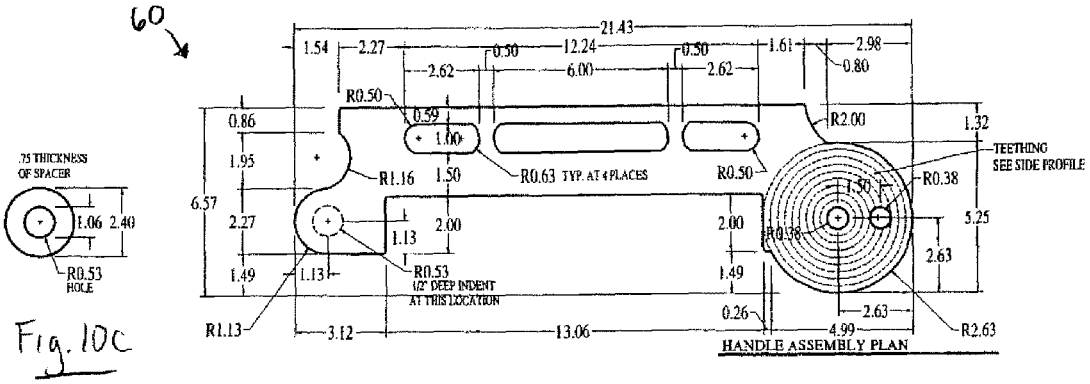
Fig. 10C
Fig. 10B

SIDE VIEW

STEP BRACKET PLAN

STEP END VIEW

STEP PLAN

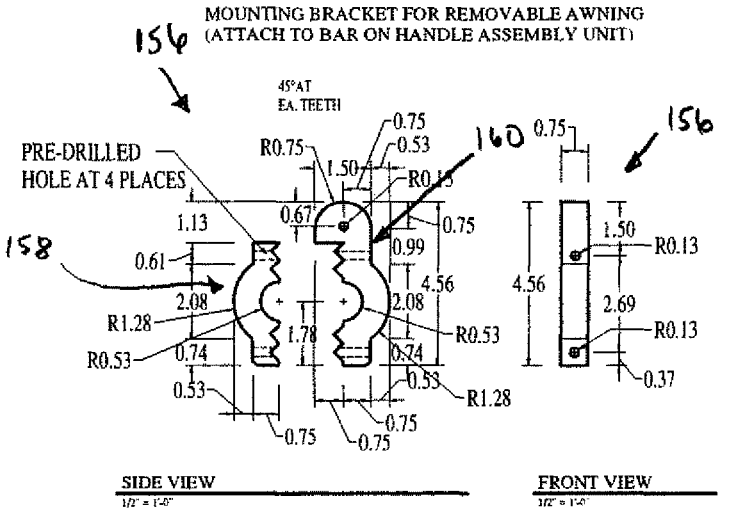
Fig. 12A
Fig. 12B
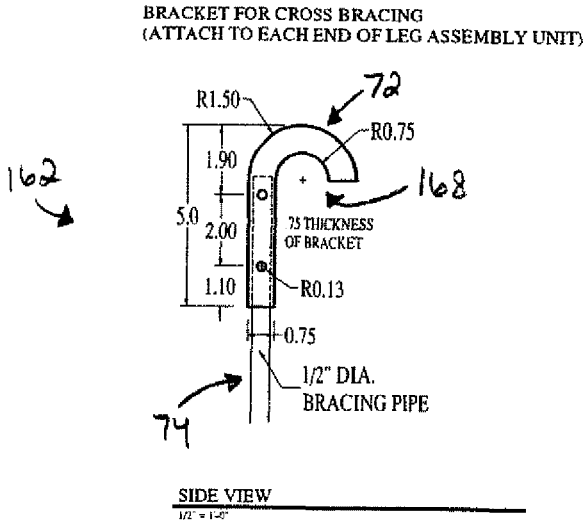
Fig. 13

MULTI-FUNCTIONAL BENCH SYSTEM FOR INFLATABLE BOATS

RELATED APPLICATION

This application claims the benefit of U.S. Provisional Patent Application Ser. No. 61/458,548, filed Nov. 29, 2010, the entirety of which is hereby incorporated by reference for all purposes.

TECHNICAL FIELD

The present invention relates generally to passenger transport systems for inflatable water craft, and more particularly to a multi-functional bench system for inflatable boats.

BACKGROUND OF THE INVENTION

Inflatable boats have been becoming increasingly popular, primarily for recreational purposes, and also for use as dinghies for transportation purposes. Such boats are advantageous because they are of relatively light weight, thus facilitating transporting thereof and, when deflated, such boats can be folded for more convenient storage. Also, inflatable boats are relatively simple and inexpensive to manufacture and hence are more economically feasible to the consumer.

The basic problem with inflatable boats of this type involves the provision of secure seating in the boat while maximizing storage area inside of the boat. One of the most hazardous drawbacks to such inflatable boats is the possibility of the boat being capsized and/or the passenger(s) being thrown overboard due to water turbulence or uneven weight distribution. Typically, inflatable boats include one or more seats that extend transversely within the boat at a desired location (or locations). Not only do these seats occupy the already minimal storage space within the boat, they also fail to provide stability to passengers during operation of the boat. Additionally, in the event that inflatable boats are used in shallow water rescue operations, the boats fail to provide a simple egress/ingress means for retrieving victims, as well as a suitable surface for performing medical interventions (e.g., CPR).

SUMMARY OF THE INVENTION

One aspect of the present invention includes a multi-functional bench system for an inflatable boat having a bottom wall, spaced apart first and second tubular side walls, and an outboard motor. The bench system comprises a first seating unit, a second seating unit, and an adjustable bracing assembly. The first seating unit is snugly mounted to a portion of the first tubular side wall. The first seating unit comprises a first leg assembly hingedly connected to a first handle assembly. The second seating unit is snugly mounted to a portion of the second tubular side wall. The second seating unit comprises a second leg assembly hingedly connected to a second handle assembly. The adjustable bracing assembly is positioned about the bottom wall of the inflatable boat and securely interconnects the first and second leg assemblies.

Another aspect of the present invention includes a multi-functional bench system for an inflatable boat having a bottom wall, spaced apart first and second tubular side walls, and an outboard motor. The bench system comprises a first seating unit, a second seating unit, and an adjustable bracing assembly. The first seating unit is snugly mounted to a portion of the first tubular side wall. The first seating unit comprises a first leg assembly hingedly connected to a first handle assembly. The second seating unit is snugly mounted to a portion of the second tubular side wall. The second seating unit comprises a second leg assembly hingedly connected to a second handle assembly. The adjustable bracing assembly is positioned about the bottom wall of the inflatable boat and securely interconnects the first and second leg assemblies. Each of the first and second leg assemblies includes a radial plane extending therethrough. The first and second handle assemblies are movable between 0° and 180° relative to the radial plane of each of the first and second leg assemblies.

Another aspect of the present invention includes a multi-functional bench system for an inflatable boat having a bottom wall, spaced apart first and second tubular side walls, and an outboard motor. The bench system comprises a first seating unit, a second seating unit, and an adjustable bracing assembly. The first seating unit is snugly mounted to a portion of the first tubular side wall. The first seating unit comprises a first leg assembly hingedly connected to a first handle assembly. The second seating unit is snugly mounted to a portion of the second tubular side wall. The second seating unit comprises a second leg assembly hingedly connected to a second handle assembly. The adjustable bracing assembly is positioned about the bottom wall of the inflatable boat and securely interconnects the first and second leg assemblies. Each of the first and second leg assemblies comprises spaced apart leg members. Each of the leg members comprises a first radial arm portion, a second radial arm portion, and a central body portion that is integrally formed with, and disposed between, the first and second radial arm portions. Each of the first and second leg assemblies includes a radial plane extending therethrough. The first and second handle assemblies are movable between 0° and 180° relative to the radial plane of each of the first and second leg assemblies. Each of the first and second handle assemblies includes spaced apart handle members.

BRIEF DESCRIPTION OF THE DRAWINGS

The foregoing and other features of the present invention will become apparent to those skilled in the art to which the present invention relates upon reading the following description with reference to the accompanying drawings, in which:

FIG. 4A is a side view showing a first major surface of the leg member in FIGS. 3A-B;

FIG. 4B is a side view showing a second major surface of the leg member in FIG. 4A;

FIG. 4C is a cross-sectional view taken along Line 4C-4C in FIG. 4B;

FIG. 4D is a top view of the leg member in FIG. 4A;

FIG. 5A is a side view showing a second major surface of the handle member in FIGS. 3A-B;

FIG. 5B is a side view showing a first major surface of the handle member in FIG. 5A;

FIG. 5C is a cross-sectional view taken along Line 5C-5C in FIG. 5A;

FIG. 5D is a bottom view of the handle member in FIG. 5A;

FIGS. 7A-F are schematic illustrations showing the components of a multi-functional bench system configured to mount to an inflatable boat having a tubular side wall with a diameter of 13 inches;

FIGS. 8A-F are schematic illustrations showing the components of a multi-functional bench system configured to mount to an inflatable boat having a tubular side wall with a diameter of 15 inches;

FIGS. 9A-F are schematic illustrations showing the components of a multi-functional bench system configured to mount to an inflatable boat having a tubular side wall with a diameter of 17 inches;

FIGS. 10A-F are schematic illustrations showing the components of a multi-functional bench system configured to mount to an inflatable boat having a tubular side wall with a diameter of 19 inches;

FIGS. 12A-B are schematic illustrations of a mounting bracket configured to support a removable awning; and FIG. 13 is a schematic illustration of a bracket and a bracing pipe for cross bracing the leg members of the multi-functional bench system in FIG. 1.

DETAILED DESCRIPTION

Figure 1:
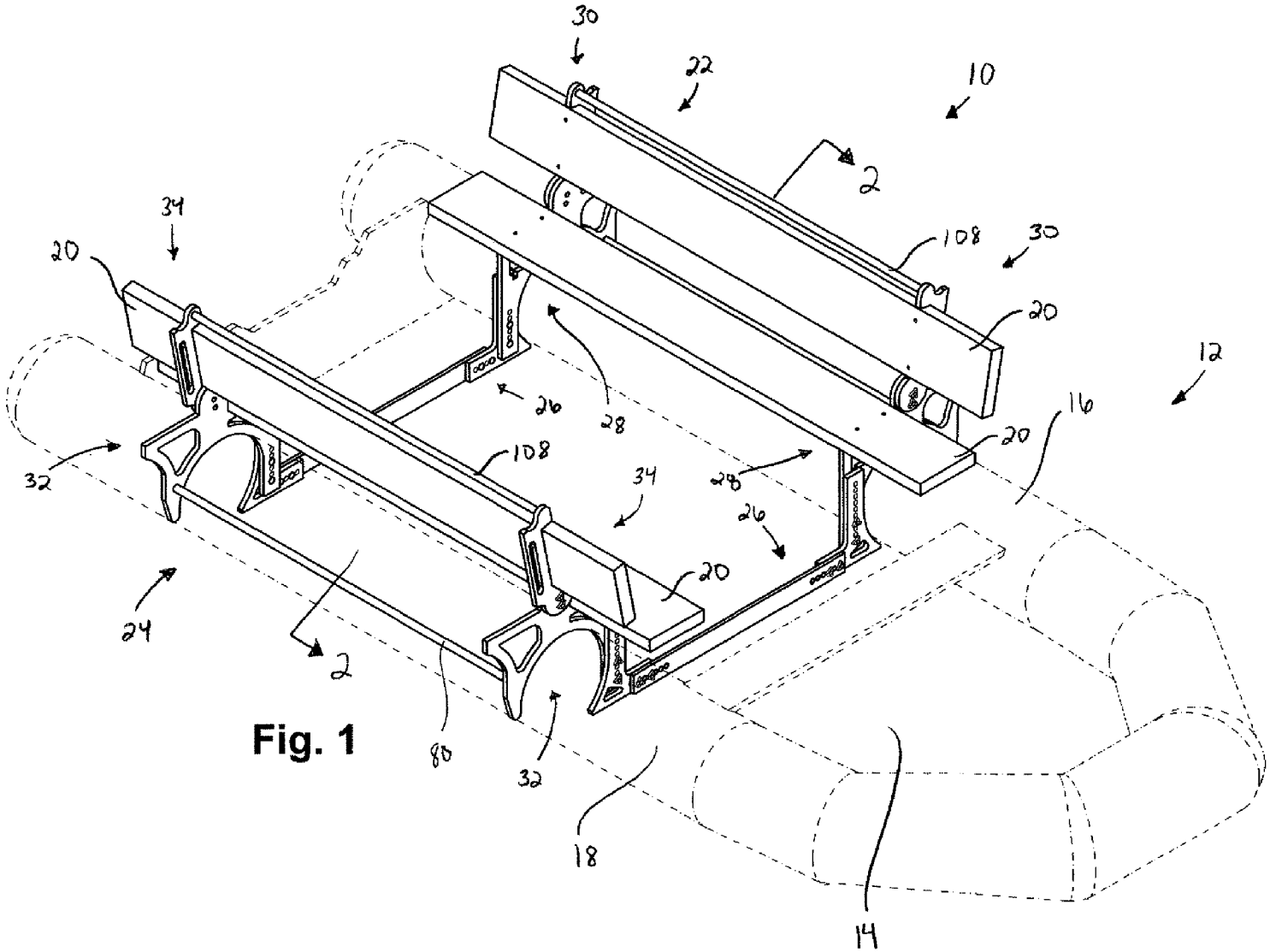
FIG. 1 is a perspective view showing an inflatable boat and a multi-functional bench system mounted thereto and constructed in accordance with one aspect of the present invention.
Figure 2:
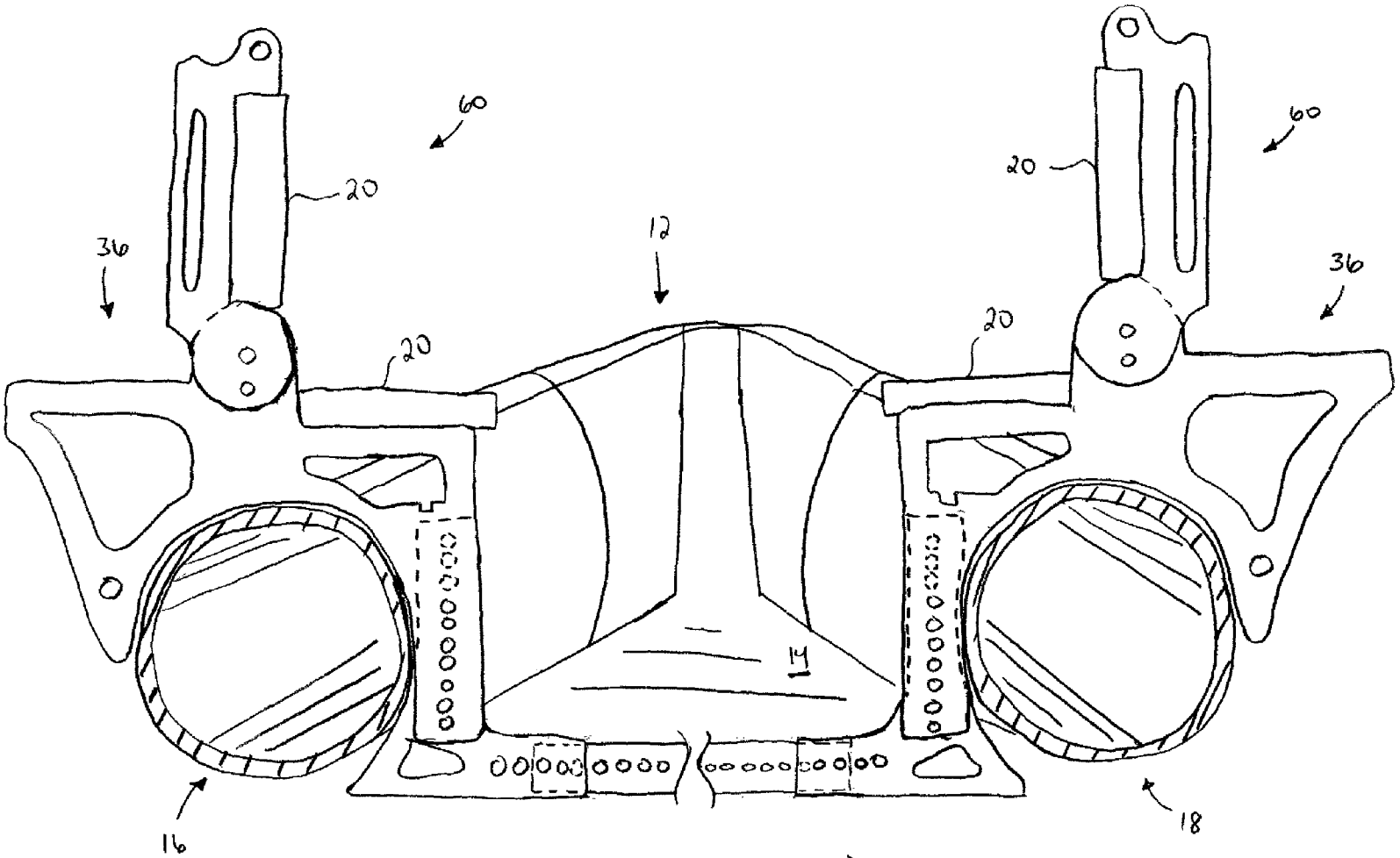
FIG. 2 is a cross-sectional view taken along Line 2-2 in FIG. 1.

The present invention relates generally to passenger transport systems for inflatable water craft, and more particularly to a multi-functional bench system for inflatable boats. As representative of one aspect of the present invention, FIGS. 1-2 illustrate a multi-functional bench system 10 for use with an inflatable boat 12 having a bottom wall 14, spaced apart first and second tubular side walls 16 and 18, and an outboard motor (not shown). As described in more detail below, the present invention provides a multi-functional bench system 10 that is portable, collapsible, and includes adjustable benches 20 for improved seating, stability, and medical rescue purposes. The bench system 10 can be easily installed on any small, personal inflatable boat 12, such as the ZODIAC ZOOM (Zodiac Recreational of North America LLC, Summerville, S.C.) and those commercially available from Achilles Inflatable Crafts and APEX (Alajuela, Costa Rica).

As noted, the present invention provides several advantages, such as improved seating space, stability for passengers during operation of inflatable boats, and a flat platform or surface for medical personnel to perform interventions (e.g., CPR) when conducting water-based rescue operations. The benches 20 included as part of the bench system 10 are longitudinally situated on top of the tubular side walls 16 and 18 of the inflatable boat 12, which advantageously provides additional seating without consuming space within the boat. Also, because of the availability of additional seating and the other components of the bench system 10, passengers are able to better balance and secure themselves during operation (e.g., to grip the bench system under turbulent conditions). Regarding use of the present invention for medical rescue purposes, the bench system 10 advantageously provides a flat surface for victims to lie on (i.e., supine), which is the optimal position for assessing victims and administering medical treatment.

The bench system 10 of the present invention is configured for securely mounting to an inflatable boat 12. The bench system 10 generally comprises a first seating unit 22, a second seating unit 24, and an adjustable bracing assembly 26. The first seating unit 22 is snugly mounted to a portion (e.g., an upper or top portion) of the first tubular side wall 16 of the inflatable boat 12. The first seating unit 22 comprises a first leg assembly 28 that is hingedly connected to a first handle assembly 30. The second seating unit 24 is snugly mounted to a portion (e.g., an upper or top portion) of the second tubular side wall 18 of the inflatable boat 12. The second seating unit 24 comprises a second leg assembly 32 that is hingedly connected to a second handle assembly 34. The adjustable bracing assembly 26 is positioned about the bottom wall 14 of the inflatable boat 12 and securely interconnects the first and second leg assemblies 28 and 32.

Figure 3B:
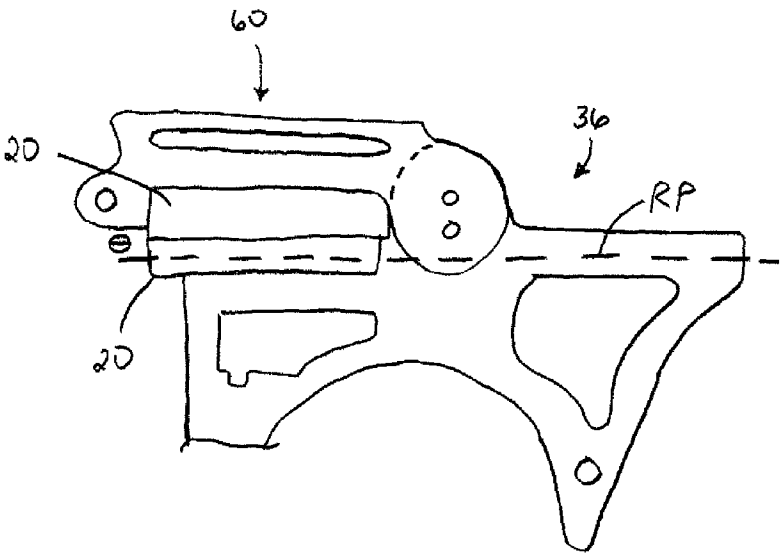
FIG. 3B is a side view of a leg member and a handle member showing the handle member at an angle (θ) of 0° relative to a radial plane that extends through the leg member.
Figure 3A:
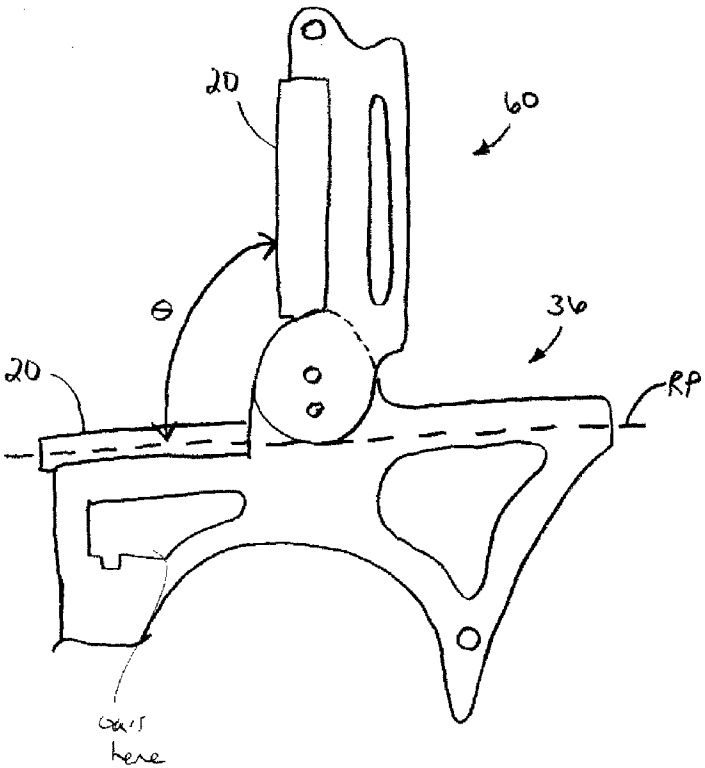
FIG. 3A is a side view of a leg member and a handle member showing the handle member at an angle (θ) of 90° relative to a radial plane that extends through the leg member.
Figure 3C:
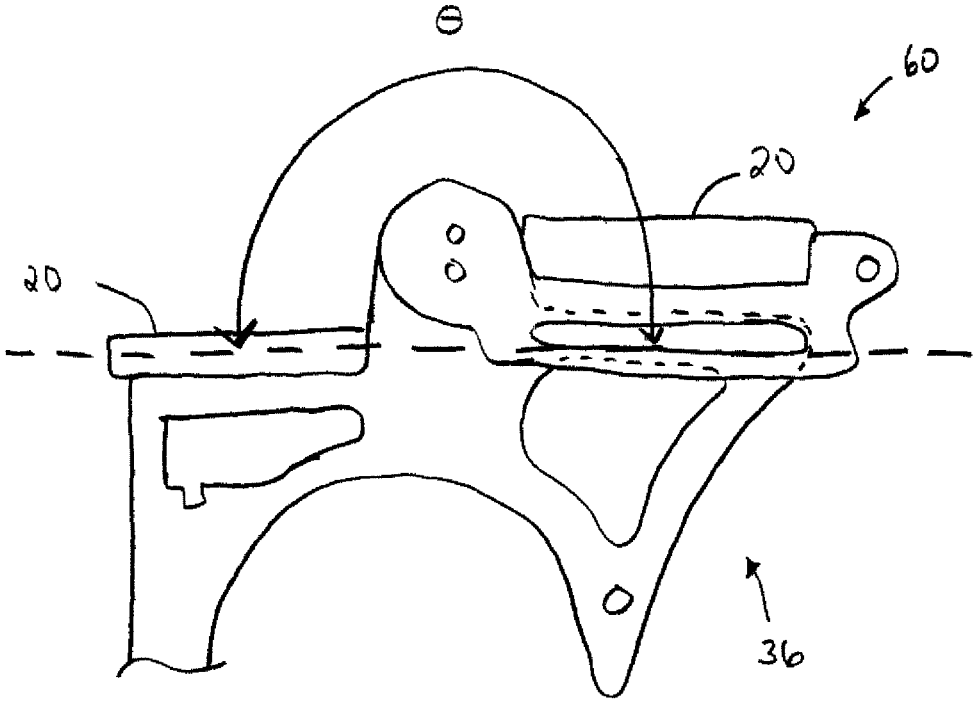
FIG. 3C is a side view of a leg member and a handle member showing the handle member at an angle (θ) of 180° relative to a radial plane that extends through the leg member.

Each of the first and second leg assemblies 28 and 32 (FIGS. 3A-C) includes a radial plane RP extending therethrough. The first and second handle assemblies 30 and 34 are movable between 0° and 180° relative to the radial plane RP of each of the first and second leg assemblies 28 and 32 (respectively). The hinged configuration of the leg assemblies 28 and 32 with the handle assemblies 30 and 34 imparts the bench system 10 with three distinct, multi-functional capabilities. As shown in FIG. 3A, when a handle assembly 30 or 34 is positioned at an angle (θ) of 90° relative to the radial plane RP, the benches 20 serve as a seat with a backrest. When the benches 20 associated with the handle assemblies 30 and 34 are in contact with the leg assemblies 28 and 32 (FIG. 3B), the angle (θ) is equal to 0° so that the bench system 10 can be easily collapsed and stored. Alternatively, when the handle assemblies 30 and 34 are positioned such that the angle (θ) is equal to 180° (FIG. 3C), the benches 20 associated with each of the handle assemblies function as a platform for medical personnel to perform CPR or other needed medical intervention(s) during a water rescue operation.

Each of the first and second leg assemblies 28 and 32 is comprised of spaced apart leg members 36. The leg members 36 can be made of a durable, water-resistant or water-proof material, such as stainless steel or a hardened plastic. More specifically, the leg members 36 can be formed from one or a combination of materials (e.g., elastomeric, rubber-like materials) to impart a receiving surface 38 (FIGS. 4A-B) with a non-skid or tacky quality and thereby prevent slippage of the bench system 10 across the tubular side walls 16 and 18 of the inflatable boat 12.

As shown in FIGS. 4A-B, each of the leg members 36 comprises a first radial arm portion 40, a second radial arm portion 42, and a central body portion 44 that is integrally formed with, and disposed between, the first and second radial arm portions. A portion of each of the first radial arm portion 40, the second radial arm portion 42, and the central body portion 44 forms the arc-shaped receiving surface 38, which is configured to snugly mate with a respective one of the first and second tubular side walls 16 and 18 of the inflatable boat 12. The first radial arm portion 40 of each leg member 36 includes a generally rectangular-shaped mating end 46 for mating with a portion of the bracing assembly 26. The mating end 46 includes a plurality of openings 48 extending between first and second major surfaces 50 and 52. Although six openings 48 are illustrated in FIGS. 4A-B, it will be appreciated that a fewer or greater number of openings may be included in the mating end 46.

Each of the leg members 36 further comprises oppositely disposed first and second major surfaces 50 and 52. A portion of the second major surface 52 includes a mating portion 54. As shown in FIGS. 4B-C, the mating portion 54 includes a plurality of teeth 56 for mating with a reciprocal mating portion 58 (FIG. 5A) of a handle member 60 (discussed below). The teeth 56 (FIGS. 4B-C) form a "valley and peak" configuration and are arranged in a series of concentric circles that emanate outward from a central locking channel 62. The central locking channel 62 extends through the mating portion 54 (i.e., between the first and second major surfaces 50 and 52). The central locking channel 62 is configured to receive a bolt (not shown) or other fastening mechanism and thereby securely and hingedly join the leg members 36 with the handle members 60.

The mating portion 54 of each leg member 36 further includes a plurality of adjustment channels 64, each of which extends between the first and second major surfaces 50 and 52. As shown in FIGS. 4A-B, the mating portion 54 includes three adjustment channels 64 that are spaced apart from the central locking channel 62 and configured to receive a removable pin (not shown). The removable pin can be selectively inserted into one of the adjustment channels 64 to move the handle members 60 into any one of the three positions illustrated in FIGS. 3A-C. Two of the adjustment channels 64 are horizontally aligned with the central locking channel 62, while a third adjustment channel is in substantial vertical alignment with the central locking channel (e.g., the third adjustment channel can be vertically offset from the central locking channel by about 10°).

The first and second radial arm portions 40 and 42 of each leg member 36 include first and second openings 66 and 68, respectively, which extend between the first and second major surfaces 50 and 52. The first opening 66 has a substantially D-shaped configuration and can be used as a storage mechanism. For example, one or more oars (not shown) can be threaded through the first opening 66 of each leg member 36, thereby eliminating the need to store the oars within the limited interior space of the inflatable boat 12. As shown in FIGS. 4A-B, the second opening 68 includes a notch 70 for cross bracing the leg members 36 using a bracket 72 and a bracing pipe 74 (FIG. 13). It will be appreciated that the first and second openings 66 and 68 can have configurations other than those illustrated in FIGS. 4A-B.

Referring to FIG. 4D, the first radial arm portion 40 and the second radial arm portion 42 respectively include second and third mating surfaces 76 and 78, each of which extends parallel to (or substantially parallel to) the radial plane RP. The second mating surface 76 extends between the first and second major surfaces 50 and 52, and has a planar or flat configuration. The second mating surface 76 is adapted to releasably mate with a portion of each handle member 60. The third mating surface 78 also extends between the first and second major surfaces 50 and 52, and has a planar or flat configuration. The third mating surface 78 is adapted to securely mate with a bench 20. For example, the third mating surface 78 can include a plurality of pre-formed drill holes (not shown) that extend into a portion of the second radial arm portion 42.

A first cross bar 80 (FIG. 1) extends between the leg members 36 comprising each of the first and second leg assemblies 28 and 32. Each of the first cross bars 80 is securely fixed between the leg members 36 via depressions 82 that are disposed within the first radial arm portion 40 of each leg member. Each depression 82 has a circular cross-sectional shape that mirrors the cross-sectional shape of the first cross bar 80. The first cross bars 80 serve to stabilize the first and second seating units 22 and 24 on the inflatable boat 12. The first cross bars 80 can also serve as a handle for a swimmer to pull himself or herself out of the water onto the inflatable boat 12. Additionally, the first cross bars 80 may serve as an attachment point for a ladder 84 (FIGS. 11A-D).

Referring to FIGS. 5A-D, each of the first and second handle assemblies 30 and 34 includes spaced apart handle members 60. Each of the handle members 60 includes a first end portion 86, a second end portion 88, and a middle portion 90 extending between the first and second end portions. Each of the handle members 60 further includes oppositely disposed first and second major surfaces 92 and 94. A portion of the second major surface 94 at the second end portion 88 of each handle member 60 includes the mating portion 58. The mating portion 58 includes a plurality of teeth 96 for mating with the reciprocal mating portion 54 of each leg member 36. The teeth 96 of the mating portion 58 form a "valley and peak" configuration and are arranged in a series of concentric circles that emanate outward from a central locking channel 98, which extends between the first and second major surfaces 92 and 94.

The mating portion 58 of each handle member 60 further includes at least one adjustment channel 100 configured to receive a pin (or other fastening mechanism) that has been inserted through one of the adjustment channels 64 in a corresponding leg member 36. As shown in FIGS. 5A-B, the adjustment channel 100 is spaced apart from, and in horizontal alignment with, the central locking channel 98. As also shown in FIGS. 5A-B, each handle member 60 includes a handle 102 located at the middle portion 90 thereof. The handle 102 is comprised of an opening 104 that extends between the first and second major surfaces 92 and 94, as well as a portion of the middle portion 90 of each handle member 60. The handle 102 can assist a user in adjusting the position of each handle assembly 30 and 34, as well as providing a way for passengers to balance and secure themselves during operation of the inflatable boat 12. Adjacent the handle 102 of each handle member 60 is a fourth mating surface 106 configured to securely receive a bench 20 that extends between the spaced apart handle members. For example, the fourth mating surface 106 can include a plurality of pre-formed drill holes (not shown) that extend into a portion of the handle member 60.

A second cross bar 108 (FIG. 1) extends between the handle members 60 comprising each of the first and second handle assemblies 30 and 34. Each of the second cross bars 108 is securely fixed between the handle members 60 via depressions 110 disposed within the first end portion 88 of each handle member. Each depression 110 has a circular cross-sectional shape that mirrors the cross-sectional shape of the second cross bar 108. The second cross bars 108 serve as a way for passengers to stabilize themselves during operation of the inflatable boat 12. The second cross bars 108 can also serve as a handle for a swimmer to pull himself or herself out of the water onto the inflatable boat 12.

As noted above, the bench system 10 includes a plurality of benches 20. Each of the benches 20 can be of equal length and have a flat, elongated configuration. The benches 20 can be made of one or combination of materials, such as wood, metal (e.g., aluminum), plastic or other known floatable material. As shown in FIG. 1, each of the leg assemblies 28 and 32 includes a bench 20 that extends between the leg members 36. In particular, each of the leg assemblies 28 and 32 includes a bench 20 that is securely attached to the third mating surface 78 of each of the leg members 36. Additionally, each of the handle assemblies 30 and 34 includes a bench 20 that extends between the handle members 60. In particular, each of the handle assemblies 30 and 34 includes a bench 20 that is securely attached to the fourth mating surface 106 of each of the handle members 60. It will be appreciated that one or more of the benches 20 can include a seat cushion (not shown), which is made of a marine foam polyurethane, for example, and a seat cover fabric that covers the foam. The cover of the seat cushion can also include a pocket, which allows the foam to easily slip into the pocket and rest over the bench(es) 20.

Referring to FIGS. 6A-D, the bracing assembly 26 of the bench system 10 comprises a plurality of bracing arms 112 and a plurality of telescoping members 114. As described in more detail below, the adjustable nature of the bracing assembly 26 allows the bench system 10 to be easily installed on inflatable boats 12 of various sizes and with various hull constructions (e.g., semi-rigid or rigid hulls made of different materials, such as wood or plastic).

Each of the bracing arms 112 has a substantially L-shaped configuration and includes a vertical arm portion 116 and a horizontal arm portion 118 that are integrally formed with one another. Each bracing arm 112 further includes oppositely disposed first and second major surfaces 120 and 122. Each of the vertical and horizontal arm portions 116 and 118 includes a plurality of openings 124 that extend between the first and second major surfaces 120 and 122. For example, the vertical arm portion 16 includes ten openings 124, and the horizontal arm portion 118 includes four openings. It will be appreciated that the vertical and horizontal arm portions 116 and 118 can include a fewer or greater number of openings 124.

The vertical arm portion 116 of each of the bracing arms 112 is configured to securely mate with the mating end 46 of each leg member 36. For example, a portion of the rectangular-shaped vertical arm portion 116 can have a length and width that is about equal to the length and width of a corresponding portion of the mating end 46 of each leg member 36. Depending upon the orientation of the first and second seating units 22 and 24, the mating end 46 of a leg member 36 can be placed into direct contact with the first or second major surface 120 or 122 of the vertical arm portion 116, and then secured thereto by inserting one or more pins (or other fastening mechanisms) through the openings 48 and 124 of each of the mating end and the vertical arm portion, respectively.

Each bracing arm 112 includes a fifth mating surface 126 having a radius of curvature that is equal to or about equal to the radius of curvature of a tubular side wall 16 or 18 of the inflatable boat 12. As shown in FIG. 2, the curvature of each bracing arm 112 allows the bracing arm to snugly mate with an exterior of the tubular side walls 16 and 18. Each of the bracing arms 112 also includes an opening 128 that extends between the first and second major surfaces 120 and 122. The opening 128 can be used to secure various accessories during operation of the inflatable boat 12, or simply be present to decrease the weight of each bracing arm 112. Each of the leg members 36 can be securely joined to the vertical arm portion 116 of each bracing arm 112 by aligning the openings 48 of the mating end 46 with the openings 124 of the vertical arm portion, and then inserting one or more pins (or other fastening mechanisms) therethrough. By including a plurality of openings 48 and 124 in the mating end 46 and the vertical arm portion 116 (respectively) through which one or more pins (or other fastening mechanisms) can be selectively inserted, the overall height of each seating unit 22 and 24 can be adjusted as needed.

Figure 6A:
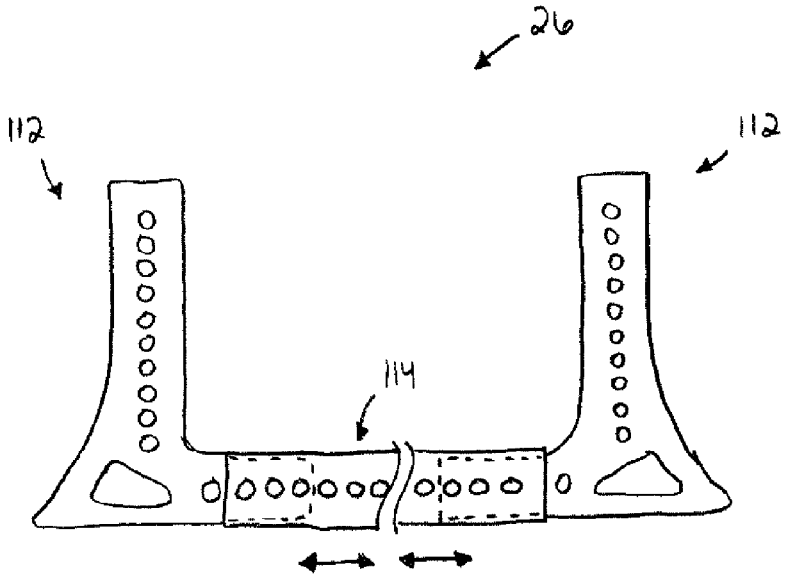
FIG. 6A is a side view of an adjustable bracing assembly comprising part of the multi-functional bench system in FIG. 1.
Figure 6B:
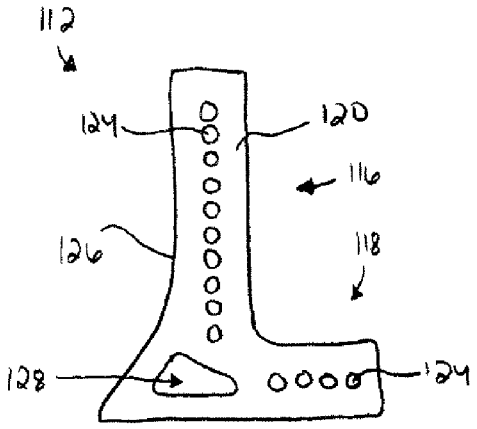
FIG. 6B is a side view showing a first major surface of a brace member comprising the bracing assembly in FIG. 6A.
Figure 6C:
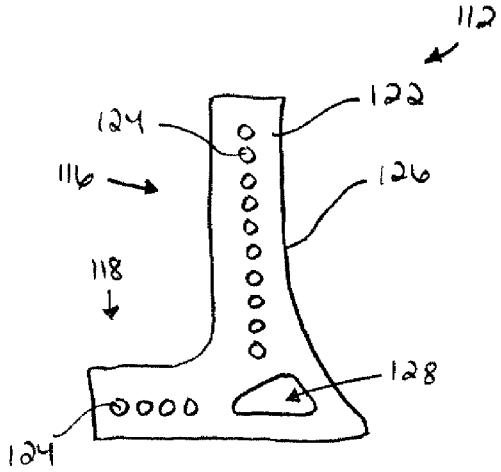
FIG. 6C is a side view showing a second major surface of the brace member in FIG. 6B.
Figure 6D:
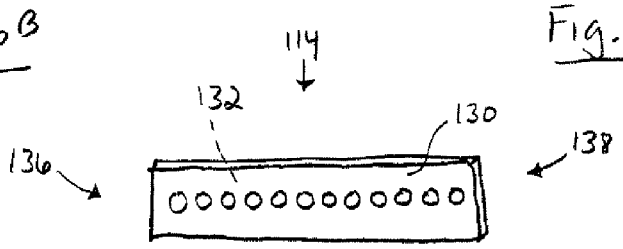
FIG. 6D is a side view of a telescoping member comprising part of the bracing assembly in FIG. 6D.
Figure 7D:
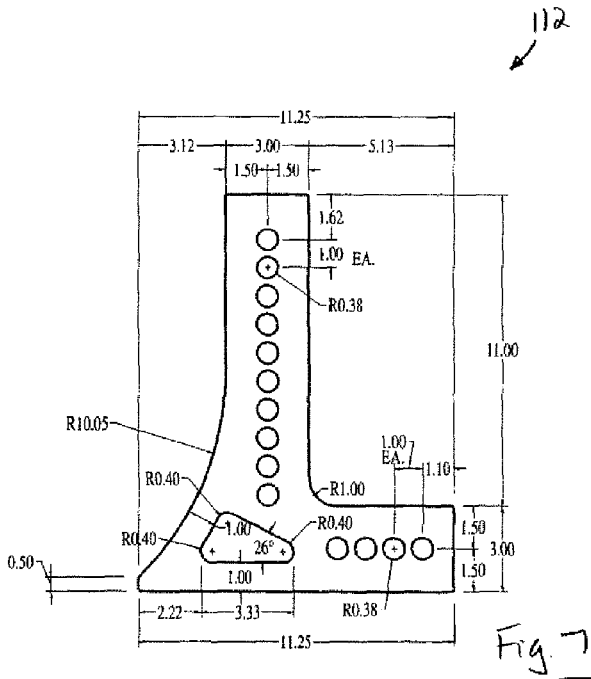
Figure 7E:
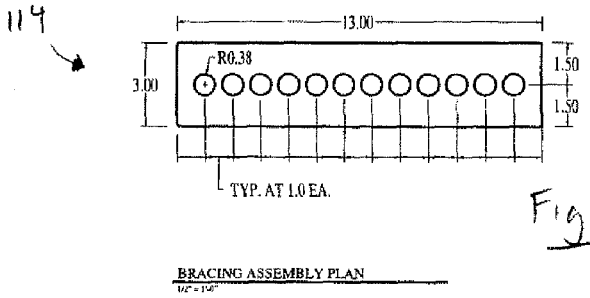
Figure 7F:
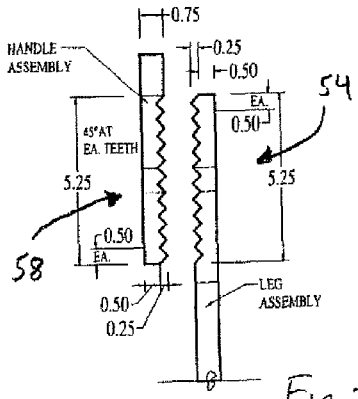
Figure 8D:
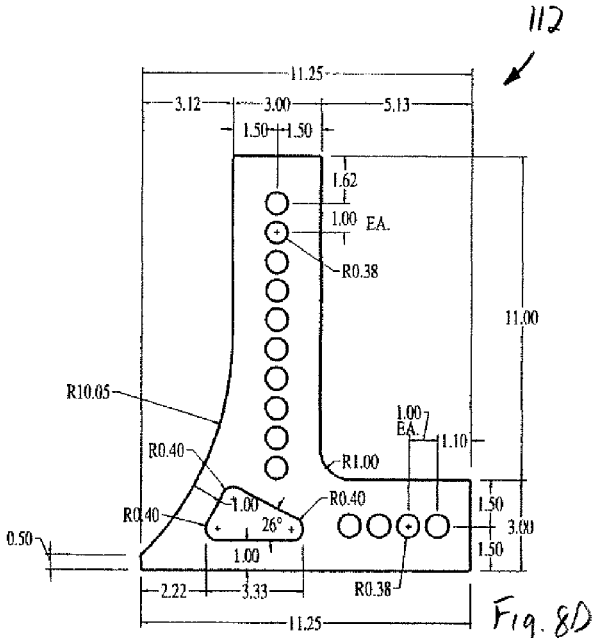
Figure 8E:
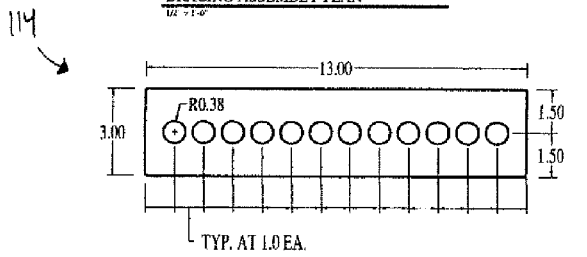
Figure 8F:
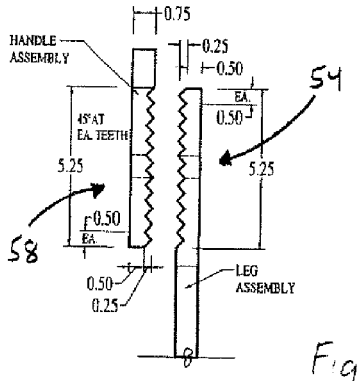
Figure 9D:
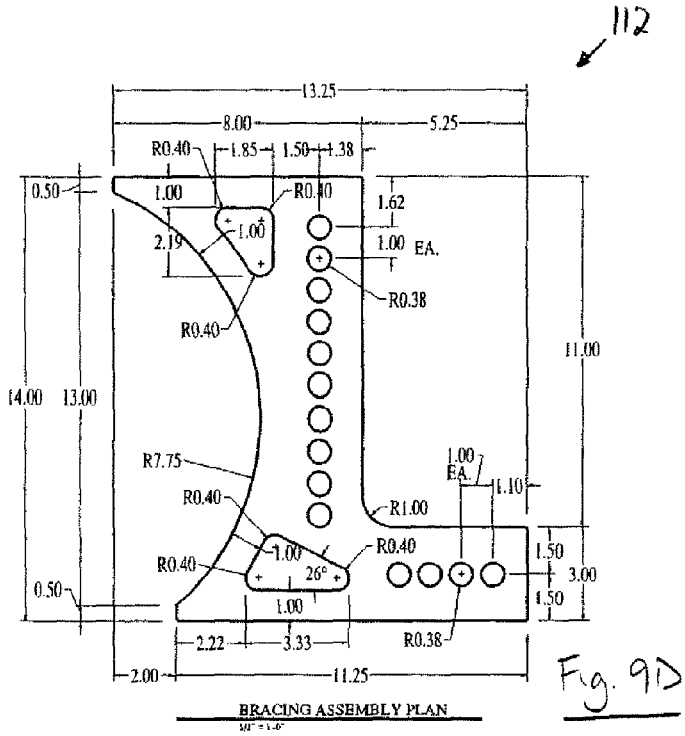
Figure 9F:
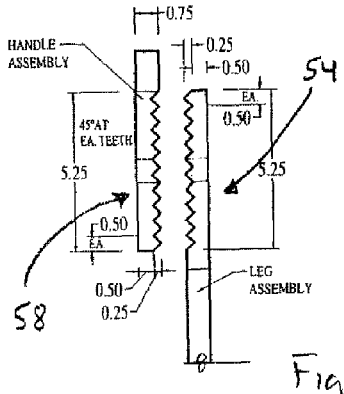
Figure 9E:
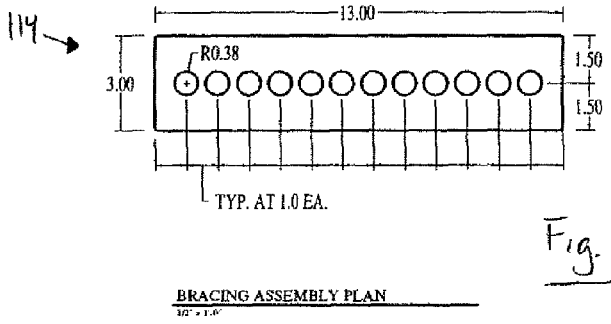
Figure 10D:
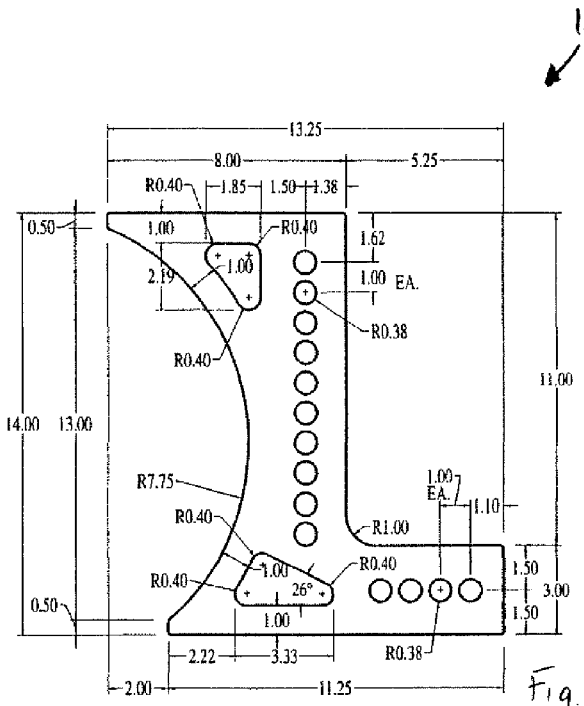
Figure 10F:
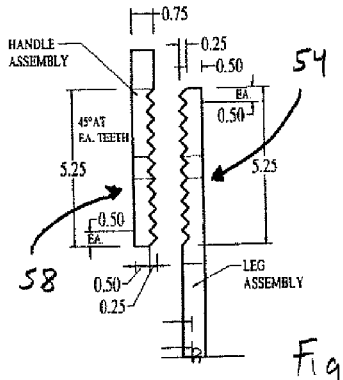
Figure 10E:
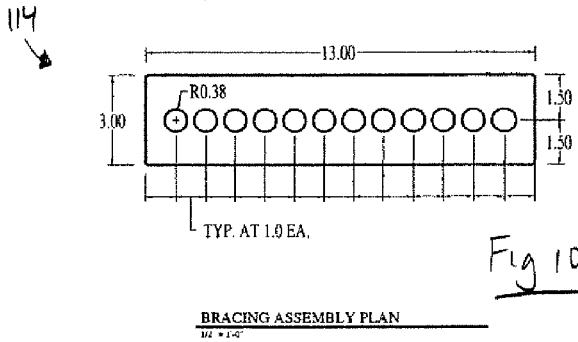

As shown in FIG. 6D, each of the telescoping members 114 has a rectangular configuration and includes oppositely disposed first and second major surfaces 130 and 132. The telescoping members 114 include a plurality of openings 134, each of which extends between the first and second major surfaces 130 and 132. Each telescoping member 114 can include twelve openings 134; although, it will be appreciated that each telescoping member can include a fewer or greater number of openings. Each of the telescoping members 114 includes first and second ends 136 and 138 that can be securely mated with the horizontal arm portion 118 of each bracing arm 112 by aligning the openings 134 at the first and second ends with the openings 124 of each different horizontal arm portion. Each of the telescoping members 114 has a width that is equal to (or about equal to) the width of the horizontal arm portion 118 of each of the bracing arms 112. The horizontal arm portions 118 and the telescoping members 114 can be securely joined by inserting one or more pins (or other fastening mechanisms) through the openings 124 and 134 of each of the horizontal arm portions and the telescoping members (respectively). By aligning the telescoping member 114 with the horizontal arm portions 118 of two bracing arms 112 and then selectively inserting two or more pins through the openings 124 and 134 of each, the overall width of the bench system 10 can be adjusted as needed.

The components of the bench system 10 can have different dimensions depending upon the type of inflatable boat 12. For example, the dimensions of certain components of the bench system 10 can vary depending upon the diameter of the first and second tubular walls 16 and 18 of the inflatable boat 12. In one example of the present invention, the bench system 10 can be configured for mounting to an inflatable boat 12 with first and second tubular side walls 16 and 18 each having a diameter of 13 inches (FIGS. 7A-E). In another example of the present invention, the bench system 10 can be configured for mounting to an inflatable boat 12 with first and second tubular side walls 16 and 18 each having a diameter of 15 inches (FIGS. 8A-E). In another example of the present invention, the bench system 10 can be configured for mounting to an inflatable boat 12 with first and second tubular side walls 16 and 18 each having a diameter of 17 inches (FIGS. 9A-E). In another example of the present invention, the bench system 10 can be configured for mounting to an inflatable boat 12 with first and second tubular side walls 16 and 18 each having a diameter of 19 inches (FIGS. 10A-E).

Figure 11A:
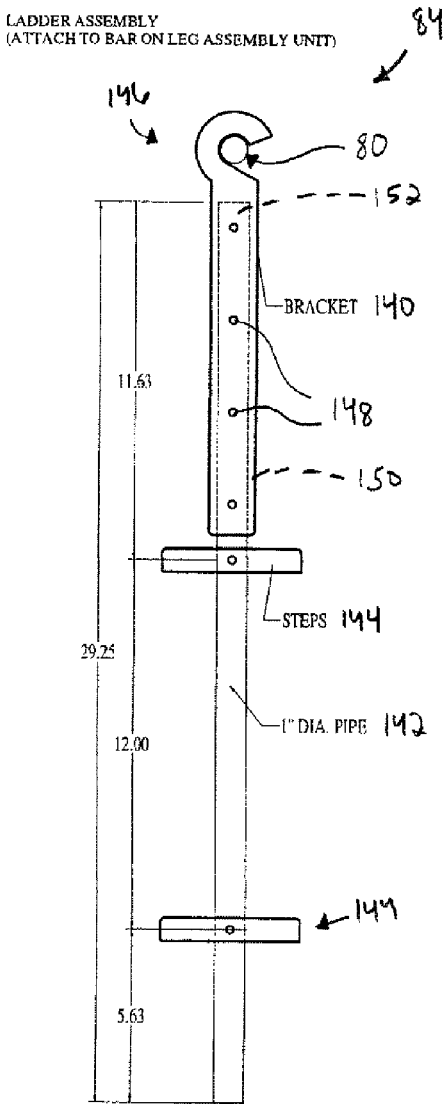
FIGS. 11A-D are a series of schematic illustrations showing a ladder configured for attachment to the multi-functional bench system in FIG. 1.
Figure 11B:
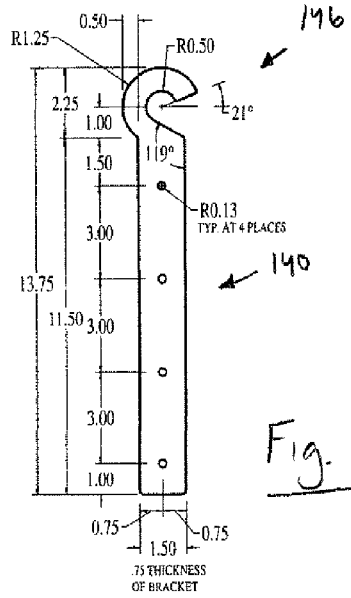
Figure 11C:
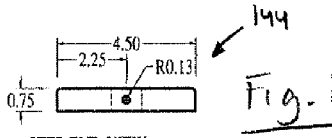
Figure 11D:
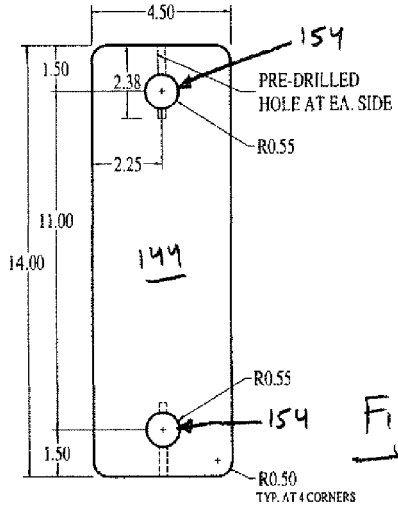

It will be appreciated that the bench system 10 can include additional accessories. As shown in FIGS. 11 A-D, for example, the bench system 10 can be configured for use with a ladder 84. The ladder 84 comprises a pair of brackets 140, a pair of elongated pipes or rods members 142, and a plurality of steps 144. Each of the brackets 140 has a curved upper portion 146 configured to securely mate with the first cross bar 80 that extends between each of the leg members 36. Each of the brackets 140 also includes a plurality of openings 148 configured to receive a screw (or other fastening mechanism). Each of the brackets 140 further includes a cavity 150 for receiving a first end 152 of each pipe or rod member 142. As shown in FIGS. 11C-D, each of the steps 144 has a rectangular configuration and includes a pair of openings 154 configured to receive a portion of each rod or pipe member 142. The ladder 84 can be readily deployed from the bench system 10 to assist in egress and ingress from and to the inflatable boat 12.

FIGS. 12A-B illustrate a bracket 156 configured to support attachment of an awning (not shown) to the bench system 10. The bracket 156 includes first and second mating components 158 and 160 that, when secured to one another (e.g., by screws), form a channel (not shown) having a cross-sectional area that is about equal to the cross-sectional area of the one of the second cross bars 108. An appropriate number of brackets 156 can be mounted to the second cross bar 108 of each handle assembly 30 and 34 to support the awning. For example, two brackets 156 can be mounted to each of the second cross bars 108 to support the awning.

FIG. 13 illustrates a bracket assembly 162 for cross bracing the leg members 36 of the bench system 10. The bracket assembly 162 includes two J-shaped brackets 72 disposed on opposite ends of a bracing pipe 74. Each bracket 72 includes a semi-circular mating end 168 configured to mate with the notch 70 on each of the leg members 36. The brackets 72 further include a cavity (not shown in detail) configured to receive an end of the bracing pipe 74. The ends of the bracing pipe 74 can be secured within the cavities of the brackets 72 by screws, for example. By mating each bracket 72 with the notch 70 on each leg member 36, the bracing pipe 74 extends longitudinally along each of the seating units 22 and 24 and thereby provides additional longitudinal support for each of the seating units.

From the above description of the invention, those skilled in the art will perceive improvements, changes and modifications. Such improvements, changes, and modifications are within the skill of the art and are intended to be covered by the appended claims.

Having described the invention, the following is claimed:

1. A multi-functional bench system for an inflatable boat, the inflatable boat having a bottom wall, spaced apart first and second tubular side walls, and an outboard motor, said bench system comprising:

a first seating unit mounted to a portion of the first tubular side wall, said first seating unit comprising a first leg assembly hingedly connected to a first handle assembly;

a second seating unit mounted to a portion of the second tubular side wall, said second seating unit comprising a second leg assembly hingedly connected to a second handle assembly; and an adjustable bracing assembly positioned about the bottom wall of the inflatable boat and interconnecting said first and second leg assemblies;

wherein each of said first and second handle assemblies includes spaced apart handle members, each of said handle members including oppositely disposed first and second major surfaces, a portion of said second major surface defining a mating portion having a plurality of teeth for mating with said plurality of teeth of said leg members.

2. The bench system of claim 1, wherein each of said first and second leg assemblies includes a radial plane extending therethrough, said first and second handle assemblies being movable between 0° and 180° relative to said radial plane of each of said first and second leg assemblies.

3. The bench system of claim 1, wherein each said first and second leg assemblies further comprises spaced apart leg members, each of said leg members comprising a first radial arm portion, a second radial arm portion, and a central body portion that is integrally formed with, and disposed between, said first and second radial arm portions.

4. The bench system of claim 3, wherein a portion of each of said first radial arm portion, said second radial arm portion, and said central body portion form an arc-shaped receiving surface configured to mate with a respective one of the first and second tubular side walls.

5. The bench system of claim 4, wherein each of said leg members further comprises oppositely disposed first and second major surfaces, a portion of each of said second major surface including a mating portion, said mating portion including a plurality of teeth, a central locking channel extending between said first and second major surfaces, and plurality of adjustment channels spaced apart from said central locking channel and extending between said first and second major surfaces.

6. The bench system of claim 4, wherein said first radial arm portion of each of said leg members includes a mating end for mating with said bracing assembly.

7. The bench system of claim 3, wherein each of said first and second seating units includes a bench that extends between, and is secured to, each of said leg members.

8. The bench system of claim 1, wherein said mating portion of each of said handle members further includes a second central locking channel that extends between said first and second major surfaces and is aligned with said central locking channel of each of said leg members, said mating portion further including an adjustment channel also extending between said first and second major surfaces for selective alignment with one of said plurality of alignment channels of said leg members.

9. The bench system of claim 8, wherein each of said first and second seating units includes a bench that extends between, and is secured to, each of said handle members.

10. The bench system of claim 1, wherein each of said first and second seating units includes first and second cross bars.

11. The bench system of claim 10, wherein said first cross bar extends between said leg members and said second cross bar extends between said handle members.

12. The bench system of claim 11, further including a ladder attached to at least one of said second cross bars.

13. The bench system of claim 11, further including at least one mounting bracket attached to each of said first cross bars, said at least one mounting bracket configured to support a removable awning.

14. The bench system of claim 1, wherein said plurality of teeth of each of said handle members is configured to mate with said plurality of teeth of each of said leg members.

15. A multi-functional bench system for an inflatable boat, the inflatable boat having a bottom wall, spaced apart first and second tubular side walls, and an outboard motor, said bench system comprising:

a first seating unit mounted to a portion of the first tubular side wall, said first seating unit comprising a first leg assembly hingedly connected to a first handle assembly;

a second seating unit mounted to a portion of the second tubular side wall, said second seating unit comprising a second leg assembly hingedly connected to a second handle assembly; and an adjustable bracing assembly positioned about the bottom wall of the inflatable boat and securely interconnecting said first and second leg assemblies;

wherein each said first and second leg assemblies further comprises spaced apart leg members, each of said leg members comprising a first radial arm portion, a second radial arm portion, and a central body portion that is integrally formed with, and disposed between, said first and second radial arm portions;

wherein a portion of each of said first radial arm portion, said second radial arm portion, and said central body portion form an arc-shaped receiving surface configured to mate with a respective one of the first and second tubular side walls;

wherein each of said leg members further comprises oppositely disposed first and second major surfaces, a portion of each of said second major surface including a mating portion, said mating portion including a plurality of teeth, a central locking channel extending between said first and second major surfaces, and plurality of adjustment channels spaced apart from said central locking channel and extending between said first and second major surfaces.

16. A multi-functional bench system for an inflatable boat, the inflatable boat having a bottom wall, spaced apart first and second tubular side walls, and an outboard motor, said bench system comprising:

a first seating unit mounted to a portion of the first tubular side wall, said first seating unit comprising a first leg assembly hingedly connected to a first handle assembly;

a second seating unit mounted to a portion of the second tubular side wall, said second seating unit comprising a second leg assembly hingedly connected to a second handle assembly; and an adjustable bracing assembly positioned about the bottom wall of the inflatable boat and interconnecting said first and second leg assemblies;

wherein each of said first and second handle assemblies includes spaced apart handle members, each of said handle members including oppositely disposed first and second major surfaces, a portion of said second major surface defining a mating portion having a plurality of teeth for mating with said plurality of teeth of said leg members;

wherein said plurality of teeth of each of said handle members is configured to mate with said plurality of teeth of each of said leg members.

* * * * *